US006305041B1

(12) United States Patent
Montague et al.

(10) Patent No.: US 6,305,041 B1
(45) **Date of Patent: *Oct. 23, 2001**

(54) POCKET TOOL WITH REMOVABLE JAWS

(75) Inventors: Phillip A. Montague, Tualatin; Edgar A. Dallas, Beaverton, both of OR (US); Paul W. Poehlmann, Heriot Bay (CA)

(73) Assignee: Alterra Holdings Corporation, Tigard, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/518,325

(22) Filed: Mar. 3, 2000

Related U.S. Application Data

(63) Continuation of application No. 08/771,449, filed on Dec. 20, 1996, now Pat. No. 6,088,860.

(51) Int. Cl.[7] ..... B25B 7/22
(52) U.S. Cl. ..... 7/128; 7/168
(58) Field of Search ..... 7/118, 128, 127, 7/129, 132, 158, 167, 168; 30/160, 161

(56) References Cited

U.S. PATENT DOCUMENTS

| | | |
|---|---|---|
| 199,868 | 1/1878 | Singleton et al. . |
| 358,312 | 2/1887 | Weck . |
| 458,664 | 9/1891 | Scholz . |
| 584,077 | 6/1897 | Jackson . |
| 677,770 | 7/1901 | Koeth . |
| 730,025 | 6/1903 | Kaufman . |
| 788,575 | 5/1905 | Bernard . |
| 866,431 | 9/1907 | Case . |
| 1,079,997 | 12/1913 | Wernimont . |
| 1,101,181 | 6/1914 | Hayden . |
| 1,169,000 | 1/1916 | Brown . |
| 1,337,769 | 4/1920 | Hemming . |
| 1,339,698 | 5/1920 | Faix . |
| 1,398,583 | 11/1921 | Bovee . |
| 1,451,607 | 4/1923 | Bates . |
| 1,614,949 | 1/1927 | Finley . |
| 2,183,901 | 12/1939 | Weaver . |
| 2,316,246 | 4/1943 | Hyatt . |
| 2,332,656 | 10/1943 | Mirando . |
| 2,575,652 | 11/1951 | Bovee . |
| 2,617,187 | 11/1952 | Hopta . |
| 2,728,984 | 1/1956 | Hopta . |
| 2,798,290 | 7/1957 | Bassett . |
| 2,832,135 | 4/1958 | Bassett . |
| 2,924,879 | 2/1960 | Kraus . |
| 3,044,081 | 7/1962 | Robinson, Jr. . |
| 3,061,927 | 11/1962 | Von Frankenberg . |
| 3,132,550 | 5/1964 | Sion . |
| 3,688,402 | 9/1972 | Shannon . |
| 3,802,286 | 4/1974 | Winklhofer et al. . |
| 3,833,953 | 9/1974 | Fisher et al. . |
| 4,006,514 | 2/1977 | Penman . |

(List continued on next page.)

FOREIGN PATENT DOCUMENTS

WO/98-18599 5/1998 (WO) .

OTHER PUBLICATIONS

Leatherman Super Tool.
Multi–Functional Tool Advertisements.

*Primary Examiner*—Eileen P. Morgan
*Assistant Examiner*—Joni B. Danganan
(74) *Attorney, Agent, or Firm*—Foley & Lardner

(57) ABSTRACT

A multi-function tool includes a cross-jaw module removably attached to a pair of channel-shaped handles with a pair of clips. Each clip removably attaching the tang of each jaw of the cross-jaw module to one of the handles. The multi-function tool also includes a spring biased wedge lock to positively lock a plurality of pivotal attached ancillary implements in an open position. An anti-rotational washer located between adjacent implements prevents rotation of a non-selected implement. The washers include a protrusion that is received in a slot in the handle.

12 Claims, 8 Drawing Sheets

U.S. PATENT DOCUMENTS

| | | |
|---|---|---|
| 4,154,125 | 5/1979 | Frank . |
| 4,167,811 | 9/1979 | Barrett . |
| 4,238,862 | 12/1980 | Leatherman . |
| 4,302,877 | 12/1981 | Hart et al. . |
| 4,451,982 | 6/1984 | Collins . |
| 4,573,268 | 3/1986 | Call . |
| 4,648,145 | 3/1987 | Miceli . |
| 4,660,284 | 4/1987 | Decarolis . |
| 4,741,106 | 5/1988 | Yamagishi . |
| 4,744,272 | 5/1988 | Leatherman . |
| 4,794,692 | 1/1989 | Wang . |
| 4,837,932 | 6/1989 | Elsener . |
| 4,882,841 | 11/1989 | Margolis . |
| 4,888,869 | 12/1989 | Leatherman . |
| 4,897,922 | 2/1990 | Brooker . |
| 4,947,552 | 8/1990 | Barnes . |
| 5,062,173 | 11/1991 | Collins et al. . |
| 5,093,995 | 3/1992 | Jan . |
| 5,111,581 | 5/1992 | Collins . |
| 5,142,721 | 9/1992 | Sessions et al. . |
| 5,210,950 | 5/1993 | Rankl . |
| 5,212,844 | 5/1993 | Sessions et al. . |
| 5,245,721 | 9/1993 | Lowe et al. . |
| 5,267,366 | 12/1993 | Frazer . |
| 5,325,588 | 7/1994 | Rogers . |
| 5,450,774 | 9/1995 | Chang . |
| 5,615,484 | 4/1997 | Pittman . |
| 5,737,841 | 4/1998 | McHenry et al. . |
| 5,765,247 | 6/1998 | Seber et al. . |
| 5,791,211 | 8/1998 | Bondhus et al. . |
| 6,009,582 | 1/2000 | Harrison et al. . |

POCKET TOOL WITH REMOVABLE JAWS

This is a continuation of application Ser. No. 08/771,449, filed Dec. 20, 1996, U.S. Pat. No. 6,088,860.

FIELD OF THE INVENTION

This invention relates to a pocket tool with retractable pliers, and other pivotally attached ancillary tools. More particularly the present invention relates to a multi-function tool which includes an easily removable retractable plier module. The present invention further relates to a pocket tool provided with a wedge locking mechanism and an anti-rotation feature to permit pivotal movement of a single ancillary tool from a plurality of adjacent ones.

BACKGROUND OF THE INVENTION

In general, multi-function tools, including in a single instrument, pliers, and other selected tools, such as screwdrivers, knife blades, files and the like are well known. The prior art multi-function tools typically include a cross-jaw pliers with channel-shaped handles connected to the shanks or tangs of the respective plier jaws. In one type of multi-function tool the cross-jaw pliers are pivotally mounted to the handles at the distal end, the jaws being adapted to nest within the handle, for storage. Examples of such multiple tools are described in U.S. Pat. Nos. 4,238,862, 4,744,272, and 4,888,869 issued on Dec. 16, 1980, May 17, 1988, and Dec. 26, 1989, respectively, to Timothy S. Leatherman.

In another type of multi-function tool, the tangs of the respective plier jaws are slidably affixed to the respective handles such that the jaws can be slidably retracted into the interior of the handle channels. Examples of such multi-function tools are described in U.S. Pat. Nos. 5,142,721 and 5,212,844 issued on Sep. 1, 1992 and May 25, 1993 respectively to Sessions et al. These patents are incorporated herein by reference.

The plier jaws of the multi-function tools identified above are mechanically attached to the handles such that assembly of the plier jaws to the handles or removal of the plier jaws requires the use of a separate tool.

Another feature of the multi-function tools described above is an integral spring formed in the region of the handle proximate the pivotally attached ancillary tools. The integral spring cooperates with a surface of each selected ancillary tool to resiliently lock each selected tool in its extended position. The selected tool is released by application of sufficient pressure to the working portion of the ancillary tool to overcome the spring force of the integral spring.

An attempt has been made to develop a positive locking mechanism for a multi-function tool by providing a tab at the end of the integral spring. The tab is received in a notch formed on the selected tool thereby positively locking the selected tool in an extended position. This approach has been incorporated in the Leatherman Super Tool® marketed by Leatherman Tool Group, Inc. However, in order to release the selected tool from the integral spring a second selected tool must be rotated approximately 90 degrees. Additionally, if all of the ancillary tools are extended and locked, a separate tool is required to unlock them.

From another standpoint, the ancillary tools in the multi-function tools described above are typically pivotally attached at a distal end of the channel-shaped handles. The rotation of a single selected tool to an extended position often results in an adjacent tool to be rotated out of the channel-shaped handle as well.

It is therefore desirable to provide a multi-function tool in which the tool head can be easily attached and removed from the handles. Additionally, it is desirable to provide a locking mechanism to positively lock a selected tool in an extended position and release the selected tool without having to extend a second selected tool. Finally, it is also desirable to provide an anti-rotational mechanism to prevent the rotation of a second tool by the rotation of an adjacent selected tool.

SUMMARY OF THE PRESENT INVENTION

A multi-function tool in accordance with one 15 aspect of the present invention comprises a removable cross-jaw module including a first jaw and a second jaw. Each jaw includes a working portion and a tang interconnected by a bearing portion. The jaws are pivotally connected at the bearing portion. The multi-function tool further includes a first handle and a second handle pivotally connected to the first handle. Each handle includes an internal channel therein. The tool also includes a pair of clips, removably attaching the cross-jaw module to the handles.

In accordance with another aspect of the invention a multi-function tool is provided with a mechanism to lock at least one of a plurality of implements pivotally attached to the tool. The tool includes a channel-shaped handle which includes a web and a pair of sides extending therefrom. The web includes a locking edge, a top surface, an oppositely facing bottom surface, and an opening therethrough. The tool further includes an axle extending transversely between the pair of sides proximate the locking edge, the axle being configured to receive a plurality of implements pivotally attached to the axle. Each implement includes a working portion and an opposed tang portion provided with a locking surface. The locking mechanism includes a wedge slidably attached to the web for engagement with the locking surface of one of the implements the implement is in an extended position. The wedge is spring biased into engagement with the locking surface.

Yet another aspect of the invention is a multi-function tool having a plurality of implements pivotally attached thereto, and an anti-rotation feature designed to prohibit the rotation of the plurality of implements when one of the implements is pivoted to an open position. The multi-function tool includes a channel-shaped handle having a web, a first side and a second side extending therefrom. The web includes a slot extending transverse to the first and second sides. The tool also includes a fastener system having an axle extending between the first and second sides, and a plurality of implements are pivotally attached to the thereto. The anti-rotation feature includes a plurality of washers, each washer being attached to the axle and separating respective implements disposed adjacent thereto. Each washer includes a protrusion extending therefrom which is received in the slot.

Other principal features and advantages of the invention will become apparent to those skilled in the art upon review of the following drawings, the detailed description and the appended claims.

BRIEF DESCRIPTION OF THE DRAWINGS

The invention will hereafter be described with reference to the accompanying drawings, wherein like reference numerals denote like elements, and.

DETAILED DESCRIPTION OF A PREFERRED EXEMPLARY EMBODIMENT

Figure 3:
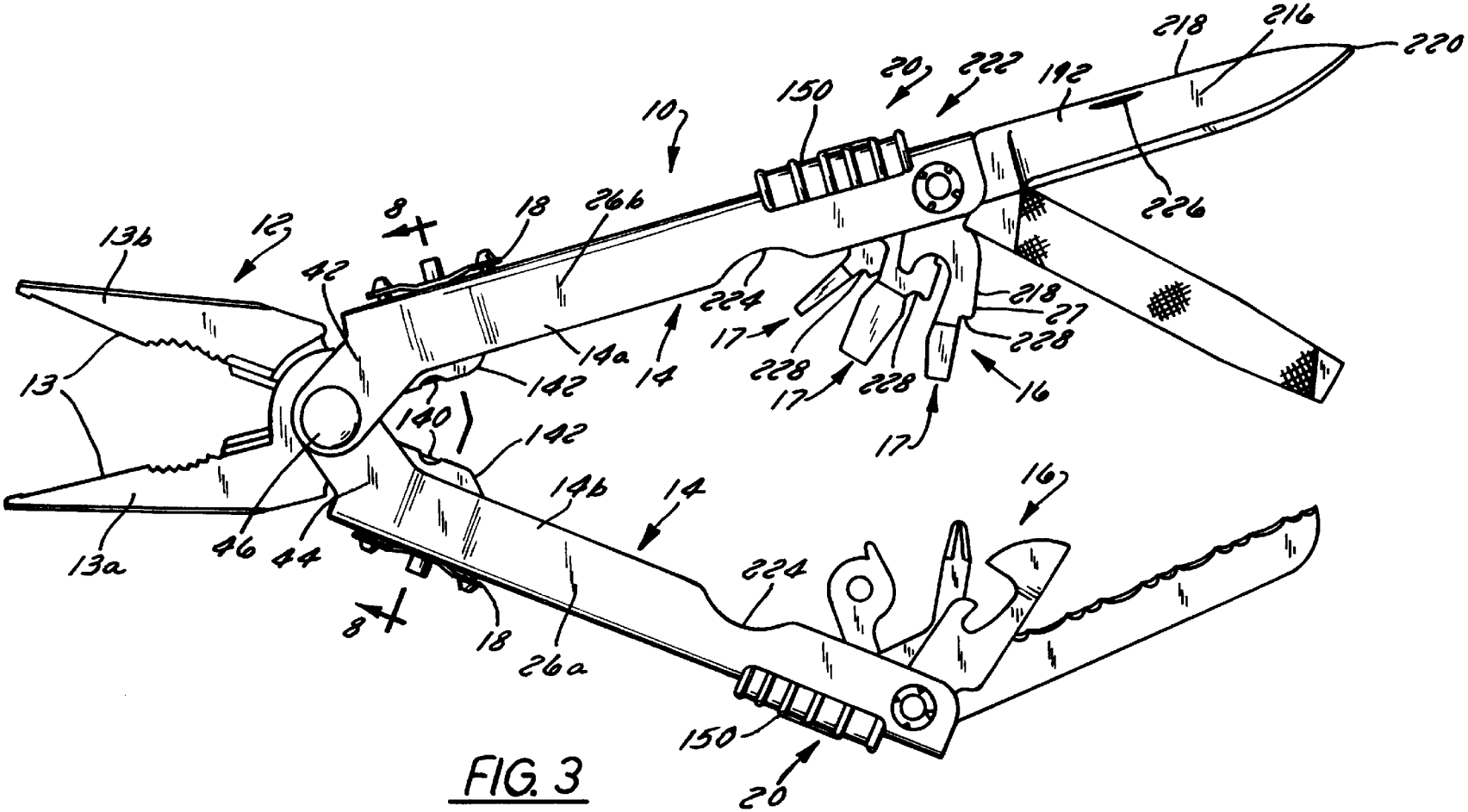
FIG. 3 is a side view of the present invention in the open position with the jaws exposed, handles open, and with the ancillary tools exposed for viewing.
Figure 10:
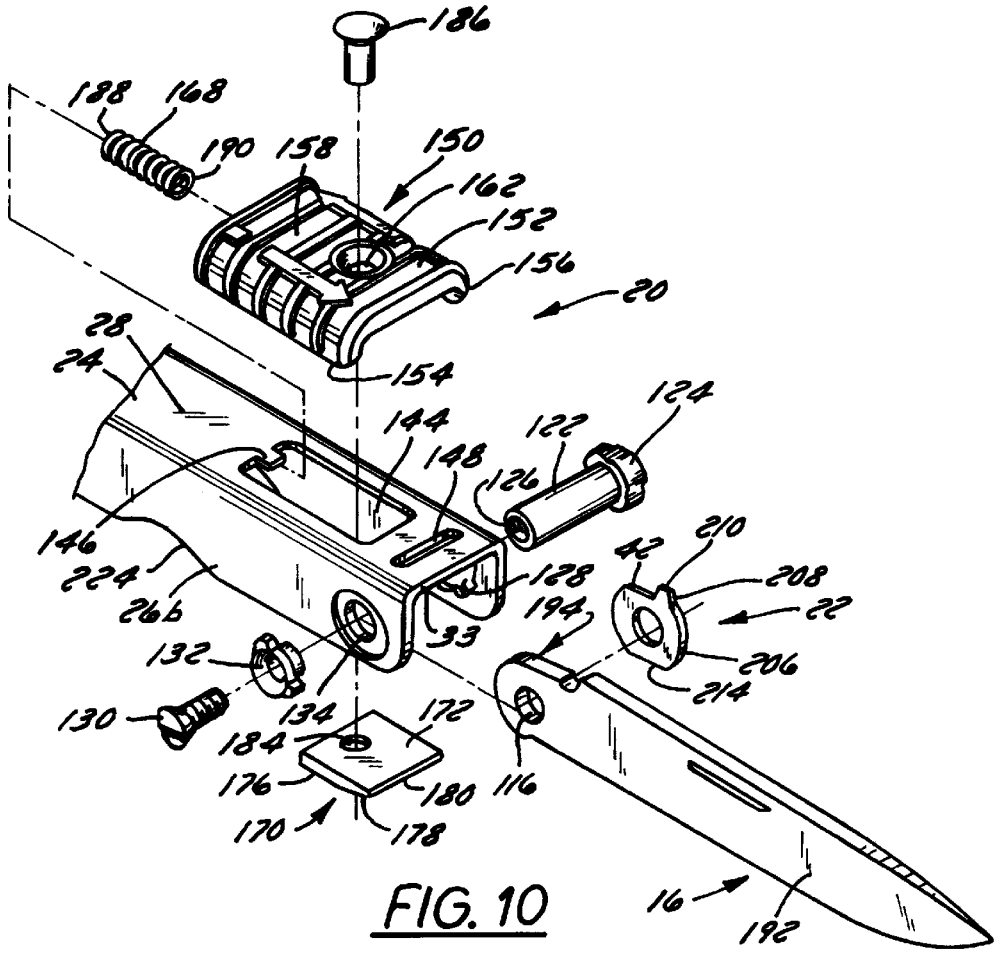
FIG. 10 is an exploded view of the locking mechanism and anti-rotational washers of the present invention.
Figure 11:
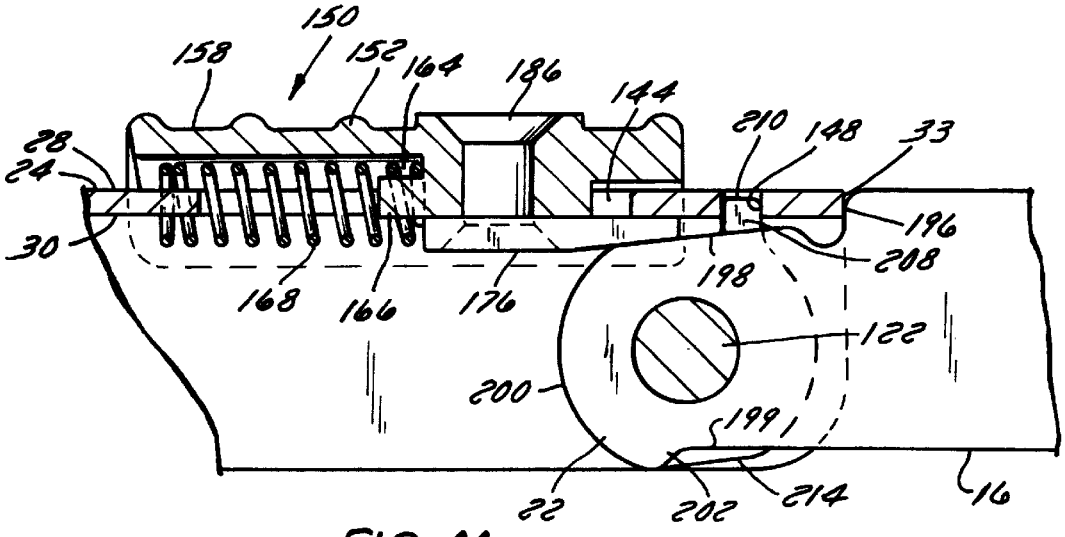
FIG. 11 is a sectional view of the locking mechanism with a blade in the extended open position.

Referring to FIG. 3, a detailed description of an exemplary tool 10 in accordance with the present invention will be described. Tool 10 includes a modular head 12, a pair of handles 14, and a plurality of pivotally attached ancillary tools or implements 16. As will be explained in greater detail below, modular head 12 is removably attached to handles 14 by a pair of retaining clips 18. In the preferred embodiment modular head 12 is a cross-jaw module or pliers. Additionally, tool 10 includes a locking mechanism 20 to positively lock ancillary tools 16 in the extended position. (FIGS. 10–11). Tool 10 further includes anti-rotation washers 22 to prohibit the rotation of adjacent ancillary tools when a single tool 16 is pivoted to an open position. (See FIG. 4)

Referring to FIGS. 1–4, handles 14 and cross-jaw pliers 12, will be described in greater detail. Handles 14 include a first handle 14*a* and a second handle 14*b* which are substantially identical, and will be described in terms of generically denominated components. Handles 14 are channel-shaped and include a web 24 connecting a pair of respective side panels 26. The interior wall of web 24 defines the transverse dimension of the handle channel. Web 24 is generally flat having a top surface 28 and a bottom surface 30. Web 24 further includes a forward edge 32, and a second distal edge or locking edge 33. A longitudinally disposed slot 34 extends through web 24.

Slot 34 is of a predetermined length, having a radiused forward terminus 36 and a radiused rear terminus (not shown). Forward terminus 36 is disposed a predetermined distance from forward edge 32. Slot 34 further includes a slot aperture 40 having a diameter greater than the width of slot 34, and situated a set distance from forward terminus 36.

Web 24 and hence the channel between sides 26 is suitably narrowed in the vicinity and forward of slot 34 to approximately the width of cross-jaw pliers 12. The interior surface of side panels 26 and preferably web 24 are highly polished to present a smooth corrosion-resistant surface to facilitate sliding movement of cross-jaw pliers 12 and retaining clips 18 as will be described below.

Each pair of side panels 26 includes a first side panel 26*a* and a second side panel 26*b* are generally planar, but conform to the configuration of web 24, i.e., they are transversely stepped in the vicinity of slot forward terminus 36. Side panels 26*a* and 26*b* are substantially identical and will be described in terms of generally denominated components where appropriate. Arms 42 and 44 extend side panels 26*a* and 26*b* of handles 14*a* and 14*b* respectively, forwardly of web forward edge 32 by a predetermined distance. Arms 42 and 44 suitably terminate in a respective portion of a pivot connection, e.g., an aperture to receive a pivot pin 46.

Arms 42 and 44 suitably dispose the pivot axis of tool 10 at a predetermined distance longitudinally forward of web forward edge 32 and a predetermined distance vertically offset from the interior surface of web 24 to align the handle pivot axis with that of cross-jaw pliers 12 when cross-jaw pliers 12 are in the extended position. The predetermined distance longitudinally forward of web forward edge 32 is chosen to ensure that web forward edge 32 does not interfere with or limit the pivotal travel of cross-jaw pliers 12 in the fully open position.

In assembly, handles 14 are disposed with their respective open channels facing and, preferably pivotally connected to one another.

Figures 4, 5, 5A, 6, 7:
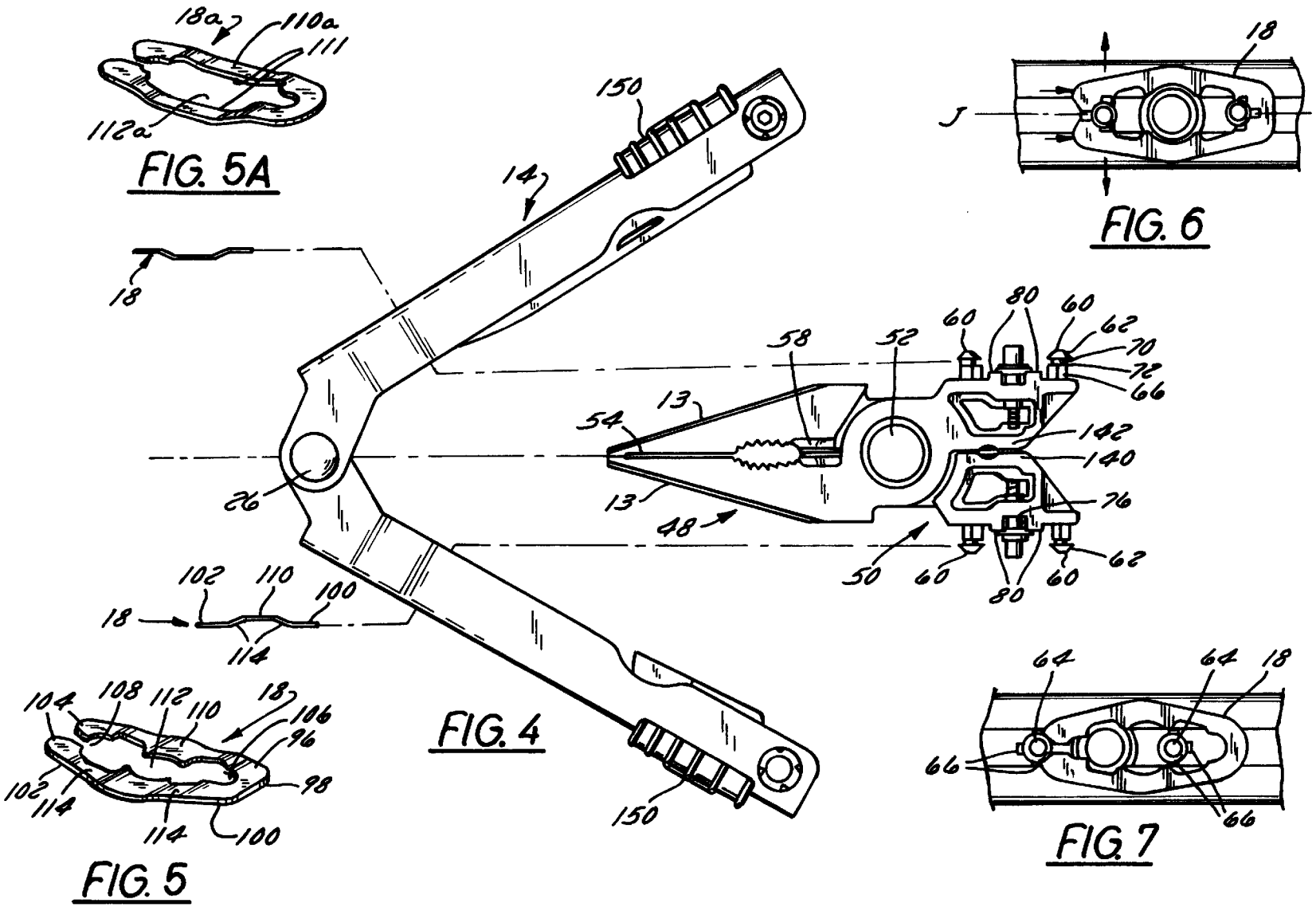
FIG. 4 is an exploded side view of the cross-jaw module, handles, and clips of the present invention.
FIG. 5 is an isometric view of the retaining clip.
FIG. 5A is an isometric view of an alternative embodiment the retaining clip.
FIG. 6 is a partial top view of the retaining clip engaged with the tang of the cross-jaw module.
FIG. 7 is a partial top view of the retaining clip in a disengaged position.

Referring to FIG. 4, cross-jaw pliers 12 include a first jaw 13*a* and a second jaw 13*b* which are substantially identical, and will be described in terms of generically denominated components. Each jaw 13 includes a working portion 48 and a tang 50 interconnected by a pivotal connection or bearing portion 52. In the preferred embodiment working portion 48 includes a first gripping region 54, a second gripping region 56, and a cutter blade 58. First and second jaws 13*a* and 13*b* are pivotally connected at bearing portion 52. Tang 50 is disposed rearwardly of pivotal connection 52 distal working portion 48. The pivotal connection of jaws 13 separate from the pivotal connection of handles 14. In the preferred embodiment, jaws 13 are made of a corrosion-resistant material such as stainless steel, with side surfaces and preferably the outer exterior top and bottom highly polished to facilitate sliding movement of jaws 13 relative to handles 14.

Each tang 50 includes a pair of tang posts 60 located a set distance from one another along a longitudinal axis J of jaw 13. (FIG. 6) Each tang post 60 includes a post head 66 having a top surface 68 and barbs 70 extending radially outward from top surface 68 by a predetermined distance. Tang posts 60 further include a plurality of ribs extending axially along the post a set distance from the bottom of barbs 70. The distance between the top of the ribs and barbs 70 defines a groove 72. As will be described below, retaining clip 18 is received within groove 72 to removably secure jaws 13 to handles 14.

Intermediate the pair of tang posts 60 is a bore 74 and a counterbore 76 configured to receive a stepped diameter pin 78. Counterbore 76 has a diameter greater than that of bore 74. Proximate counterbore 76 and intermediate tang posts 60 is a pair of tang slide surfaces 80.

Pin 78 includes a first (small diameter) portion 82 of a diameter slightly less than the width of slot 34, a second (intermediary diameter) portion 84 of a diameter greater than the width of slot 34, but slightly less than the diameter of slot aperture 40, a third (large diameter) portion 86 of a diameter larger than the diameter of bore 74, but less than that of counterbore 76, and a fourth portion 88 of a diameter slightly less than the diameter of bore 74. The combined thickness of portions 84 and 86 of pin 78 is no more than the height of tang slide surfaces 80.

Figure 8:
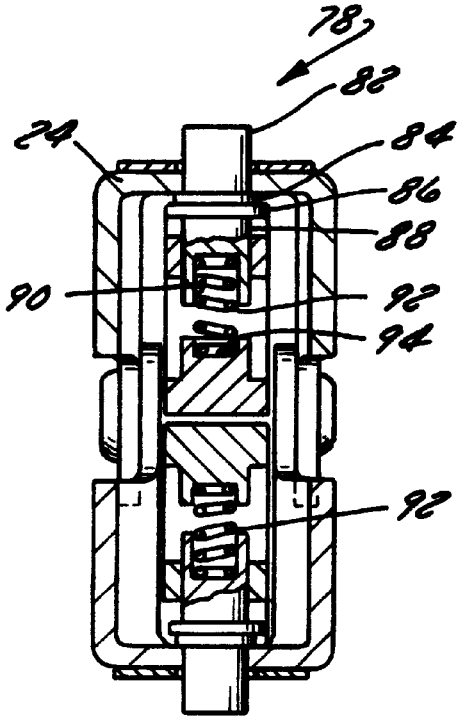
FIG. 8 is a cross-sectional view taken generally along line 8—8 of FIG. 3.
Figure 9:
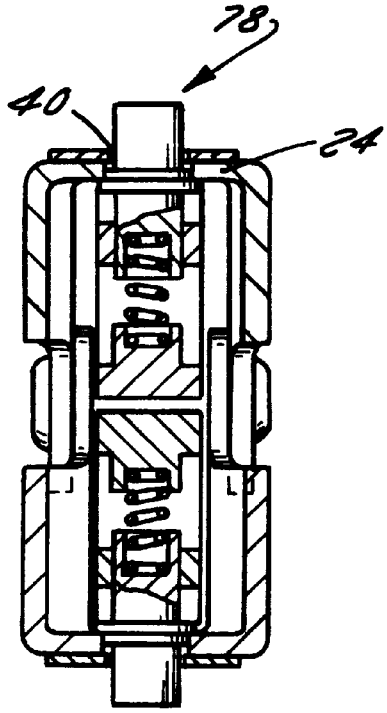
FIG. 9 is a cross-sectional view taken generally along line 9—9 of FIG. 2.

An axial bore 90 is formed in pin 78 extending inwardly through portion 88, to partially receive and retain a compression spring 92. Compression spring 92 includes a tang (not shown) which creates a friction lock in axial bore 90 when inserted. One end of spring 92 is supported on a base 94. (FIGS. 8 and 9).

Referring to FIGS. 4–7 retaining clip 18 includes a top surface 96 and a bottom surface 98 opposite top surface 96. Clip 18 further includes a first region 100 having a closed end and a second region 102 having an open end defining two prongs 104. First region 100 includes a first aperture 106 having a diameter slightly larger than the diameter of groove 72 of tang post 60. Second region 102 includes a second aperture 108 having a diameter slightly larger than the diameter of tang posts 60 at groove 72. First and second regions 100, 102 are co-planar.

Clip 18 further includes a center region or portion 110 intermediate the first and second regions 100, 102. Center region 110 is offset from and parallel to first and second regions 100, 102. Center region 110 includes an aperture 112 having a diameter slightly larger than the diameter of slot aperture 40. center region 110 is connected to first and second regions 100, 102 by angular portions 114. Clip 18 includes a continuous open area between the first and second apertures 106, 108.

Referring to FIG. 5A, a preferred embodiment clip 18*a* is illustrated. In contrast to clip 18 illustrated in FIG. 5 which includes aperture 112, the center region 110*a* of clip 18*a* does not include a reduced region defining a circular aperture. Rather, center region 110*a* of clip 18*a* includes an aperture 112*a* defined by parallel walls 111. The varying geometry of clip 18*a* permits greater ease-of-assembly for the end user. While clip 18*a* is the preferred embodiment, clip 18 may be used as well.

Referring to FIGS. 3, 4, 6 and 7 the assembly of cross-jaw pliers 12 to handles 14 will be described. Handles 14 are pivoted about pivot 46 such that the distal edge 33 of handles 14 are away from one another until there is sufficient clearance to permit insertion of tangs 50 of jaws 13 within the channel of handles 14. Handles 14 are pivoted back toward one another such that tang posts 60 extend through slot 34.

Clips 18 are attached to tang posts 60 such that bottom surface 98 of central region 110 is located adjacent top surface 28 of web 24, and top surface 96 of the first and second regions 100, 102 is located adjacent the bottom of tang post head 66.

By design the distance between central region 110 and first and second regions 100, 102 is less than the distance between the top surface 28 of web 24 and the bottom of tang post head 66. In this manner, clip 18 is resiliently deformed and acts as a spring to securely bias tang slide surface 80 against the bottom surface 30 of web 24. (See FIG. 2). Similarly, bottom surface 98 of central region 110 remains in contact with top surface! 28 of web 24.

Referring to FIG. 7, clip 18 is attached to tang posts 60 by first positioning open end of clip 18 into groove 72 of a first post 60. Application of pressure to the closed end of clip 18 forces prongs 104 at the open end outwardly until aperture 108 is in alignment with a first post 60 permitting prongs 104 to resiliently spring back onto the first post 60 in groove 72. The closed end of clip 18 is held within groove 72 of second tang post 60.

Clip 18 is removed from tang posts 60, by spreading prongs 104 at the open end and simultaneously applying pressure to the open end of clip 18. (FIG. 6). In this manner clips 18 are disengaged from tang posts 60 permitting removal and replacement of cross-jaw pliers 12.

Referring to FIGS. 2, 3, 8 and 9 the movement of cross-jaw pliers 12 within handles 14 will be described. Jaws 13 are adapted to be moved relative to handles 14 between an extended position (see FIG. 3) and a retracted or closed position (See FIG. 2). In the extended position working portions 48 of jaws 13 are disposed forward of handles 14 and are capable of pivotal movement with respect to each other in response to divergence and convergence of handles 14, i.e., open and close in response to operation of handles 14. In the retracted position working portions 48 are at least partially, and preferably substantially, contained within the channels of handles 14, and handles 14 are, in effect, locked in a closed position.

When jaws 13 are in a fully extended position, bore 74 underlines slot aperture 40 such that intermediate diameter portion 84 of pin 78 is received in slot aperture 40, with the ledge of large diameter portion 86 biased against the bottom surface 30 of web 24 by a coil or compression spring 92. (See FIGS. 3 and 9). When intermediate diameter portion 84 is received within slot aperture 40, jaws 13 are unable to slide relative to handle 14.

To retract jaws 13, portion 82 of pin 78 is depressed, overcoming the bias of spring 92, to cause intermediate diameter portion 84 to retract into tang counterbore 76. Jaws 13 can then be retracted, with small diameter portion 82 of pin 78 slidably received within slot 34 and the ledge of intermediate diameter portion 84 biased by spring 92 against the bottom of web 24. (See FIGS. 2 and 9).

Figure 1:
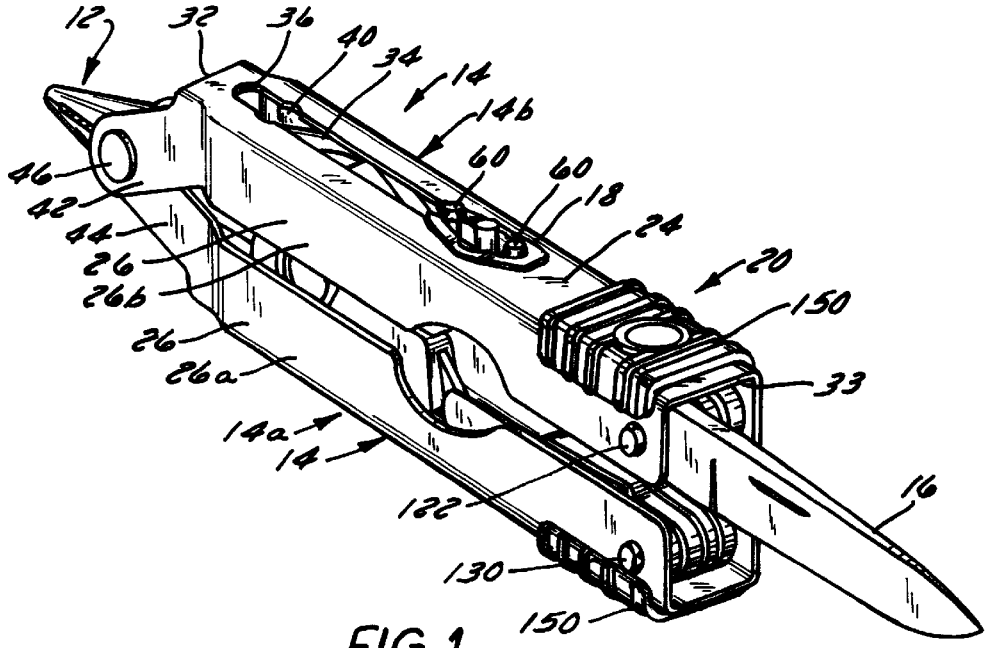
FIG. 1 is an isometric view of the pocket tool of the present invention in the closed position with a single blade extended.
Figure 2:
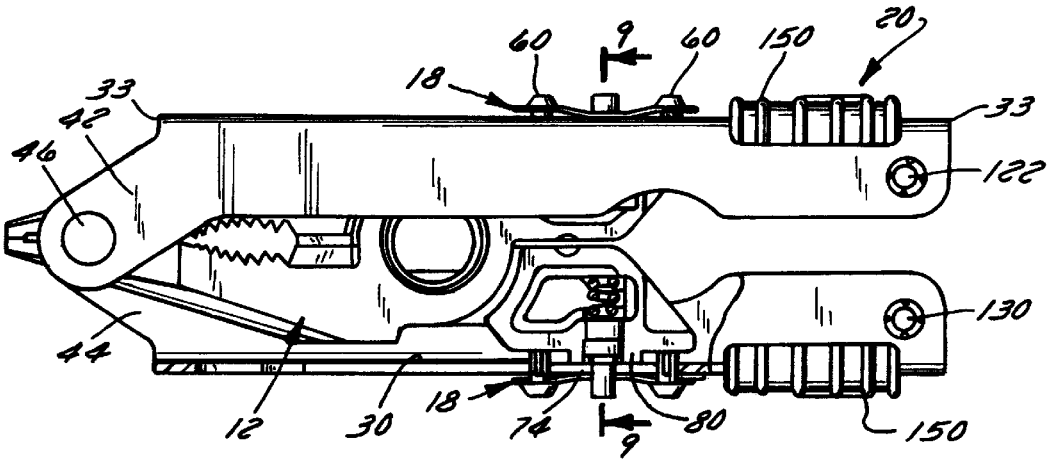
FIG. 2 is a fragmentary side view of the present invention of FIG. 1.

Referring to FIGS. 2 and 9, tang slide surfaces 80 are biased against bottom surface 30 of web 24 by clip 18. The friction resulting from the contact of tang slide surfaces 80, and the contact of the ledge of intermediate diameter portion 84 with the bottom surface 30 of web 24, coupled with the contact of the bottom surface 98 of the center region 110 of clip 18 against top surface 28 of web 24 serves to maintain jaws 13 in a retracted position. Subsequent, movement of jaws 13 to an extended position requires adequate force to overcome the frictional force described above.

Referring to FIG. 3, each tang 50 includes a crimp portion 140 and a stop surface 142. Crimp portions 140 interact to permit the crimping of an object when the two handles 14 are pivoted to a closed position. Stop surfaces 142 of tangs 50 interact as a stop to limit the travel of handles 14 toward one another.

As noted above, ancillary tools 16 are pivotally mounted to the distal ends of handles 14. Each ancillary tool includes an aperture 116 located within the ancillary tool tang or base 118 for attachment to a fastener system 120. (See FIG. 10)

Figure 17:
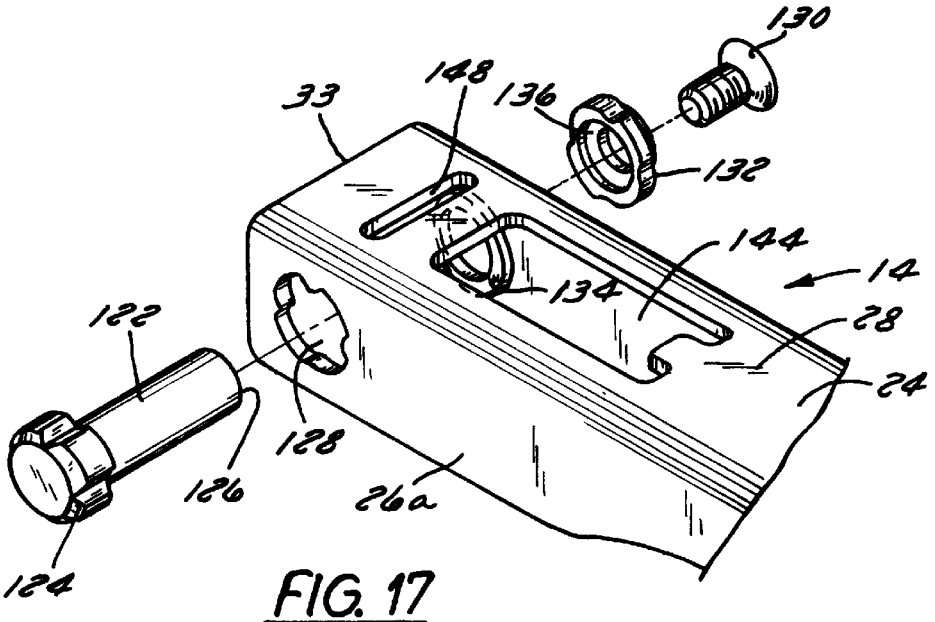
FIG. 17 is an exploded view of the axle assembly of the present invention.

Referring to FIG. 17, fastener system 120 includes an axle bolt 122 having a keyed head 124 and an internal threaded bore 126. Axle bolt 122 is received within a keyed aperture 128 located through side wall 26*a* proximate distal edge 33 of handle 14. Axle head 124 is keyed to side wall 26*a* to prevent rotary motion of axle bolt 122.

Axle bolt 122 is secured to held in place proximate the side wall 26*b* by screw 130. An axle washer 132 is received in a radial aperture 134 in side wall 26*b*. As noted Above axle bolt 122 is permitted to float move substantially perpendicular relative to side panel 26*a* to ensure proper contact with the ancillary tool 16 adjacent axle head 124. The proper level of tension compression against the ancillary tools is obtained by tightening screw 130 to a specified torque. Axle washer 132 includes a recess 136 to receive the outer diameter of axle bolt 122. Axle washer recess 136 allows axle bolt 122 to be adjusted for any tolerance which may affect ancillary tool stackup. In this manner fastener system 120 is fixedly attached solely to side wall 26*b*.

Figure 18:
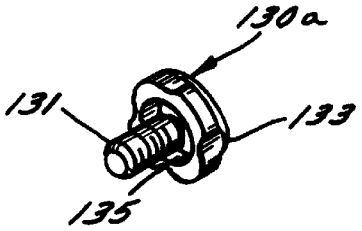
FIG. 18 is a perspective view of an integrated screw component.

As illustrated in FIG. 18, screw 130 and axle washer 132 may be combined in a single integrated component 130*a*. The combined washer and screw component 130*a* allows for greater ease of assembly. Screw component 130*a* includes a threaded screw portion 131 and a head portion 133 having a circular recess 135 therein proximate threaded screw portion 131.

Referring generally to FIGS. 10–16 locking mechanism 20 will now be described. Handles 14 include a rectangular opening 144 extending through web 24 located proximate distal edge 33 of web 24. Web 24 includes a spring post 146 extending into rectangular opening 144 by a predetermined distance toward distal edge 33. Web 24 further includes a key slot 148 located intermediate rectangular opening 144 and distal edge 33. Key slot 148 extends transverse to side walls 26*a* and 26*b* and substantially parallel to distal edge 33.

Locking mechanism 20 includes a lock release button 150 having a top section 152, and a pair of side walls 154 extending therefrom defining a cavity. Top section 152 and pair of side walls 154 have an inner surface 156 and an opposed outer surface 158.

A heel portion 160 having a generally rectangular shape extends from inner surface 156 of top section 152. Heel portion 160 extends from top section 152 a distance less than the extension of side walls 154. Top section 152 and heel portion 160 include an aperture 162 extending therethrough. Heel portion 160 also includes a recessed area 164 having a fastening means 166 to receive one end of a compression spring 168. In the preferred embodiment fastening means 166 is a post configured to receive one end of a compression spring 168, such that the inner diameter of compression spring 168 would fit over post 166. However, fastening means 166 could also be a recess configured to receive the outer diameter of compression spring 168.

Heel portion 160 and spring 168 may have other configurations as well. For example spring 168 may be a serpentine type spring, which would be received in a rectangular opening in the heel portion.

Referring to FIGS. 10 and 11, lock release button 150 is located on top surface 28 of web 24 proximate rectangular opening 144 such that heel portion 160 extends through rectangular opening 144. Side walls 154 of button 150 extend beyond web 24 and cover a portion of side walls 26 of handle 14.

Locking mechanism 20 includes a wedge 170 having a top planar surface 172 and a bottom surface 174 having a first region 176 parallel with top planar surface 172. Wedge 170 also includes a front edge 180 proximate the second beveled region 178 and a rear edge 182 distal front edge 180. Wedge 170 further includes an aperture 184 extending through the first region of the bottom surface.

A rivet 186 extends through aperture 162 in top section and heel portion, and aperture 184 in wedge 170 to secure wedge 170 to button 150. In this manner beveled region 178 is proximate distal end 33 of handle 14, and top surface 172 of wedge is adjacent heel portion 160. Additionally, rear edge 182 of wedge 170 is in alignment with rear edge of heel portion 160.

Spring 168 is a compression spring which is positively disposed between a portion of handle 14 and wedge 170. Compression spring 168 includes a first end 188 and a second distal end 190. First end 188 is positively located by spring post 146 extending from web 24. Second distal end 190 is positively located by fastening means 166 of heel portion 160. Spring 168 has a length sufficient to bias button 150 toward distal edge 33. As noted above, spring post 146 and fastening means 166 are received within the inner diameter of spring 168.

Referring to FIGS. 10 and 11, ancillary tool 16 has a working portion 192, and a tang portion 194. Tang portion 194 includes a back edge 196, a locking surface 198 proximate back edge 196, an arcuate portion 200 extending from locking surface 198, and an opening tang 202 adjacent arcuate portion 200 Additionally, tang portion 194 includes a recessed surface 199.

Referring to FIG. 11, locking mechanism 20 positively secures blade 16 in the extended position such that ancillary tool 16 cannot be rotated clockwise to the a closed position without the manual retraction of wedge 170 by activation of button 150. In contrast, ancillary tool 16 is not positively secured in the closed position. (See FIG. 13).

Figure 12:
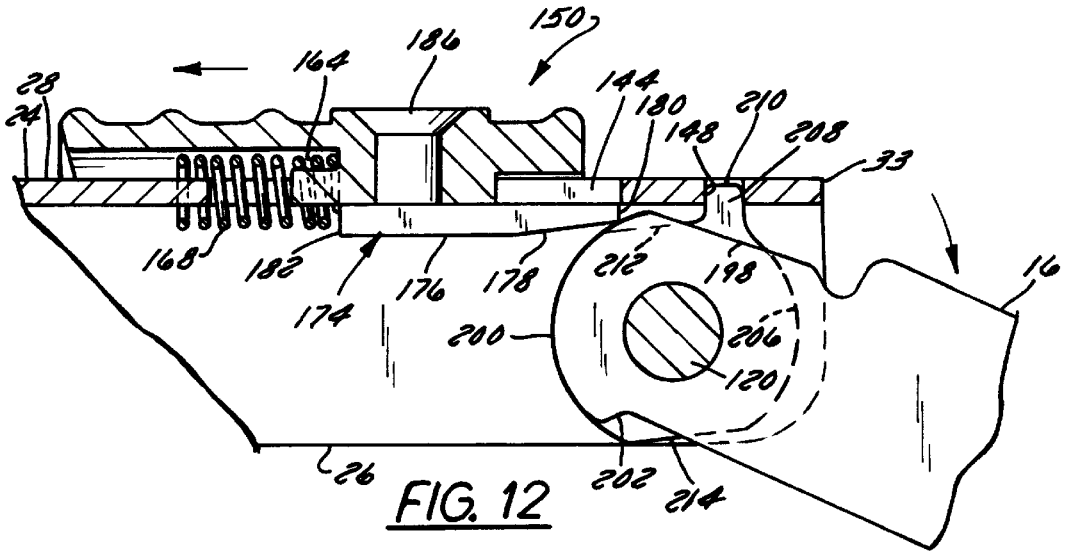
FIG. 12 is a partial sectional view of the locking mechanism when the blade is in a partially open position.
Figure 14:
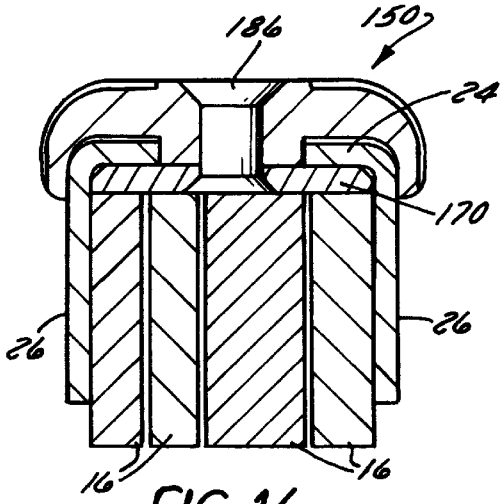
FIG. 14 is a cross-sectional view taken generally along line 14—14 of FIG. 13.
Figure 13:
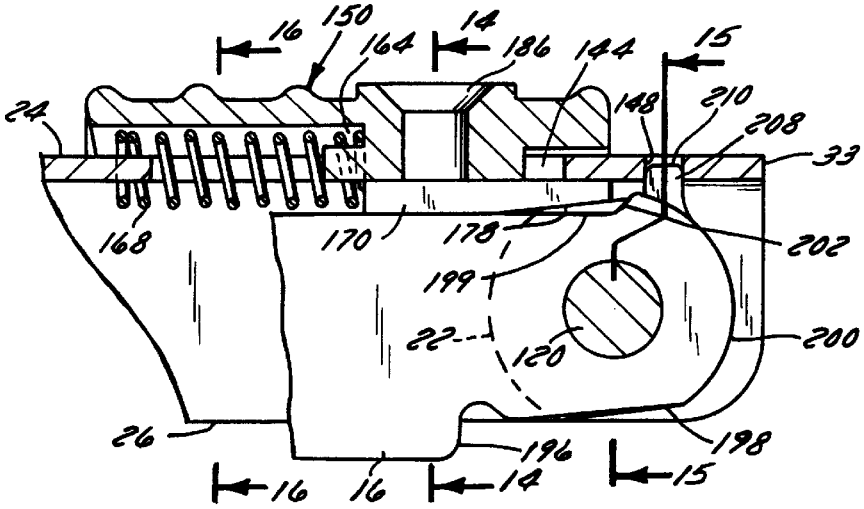
FIG. 13 is a partial sectional view of the locking mechanism when the blade is in a retracted closed position.
Figure 16:
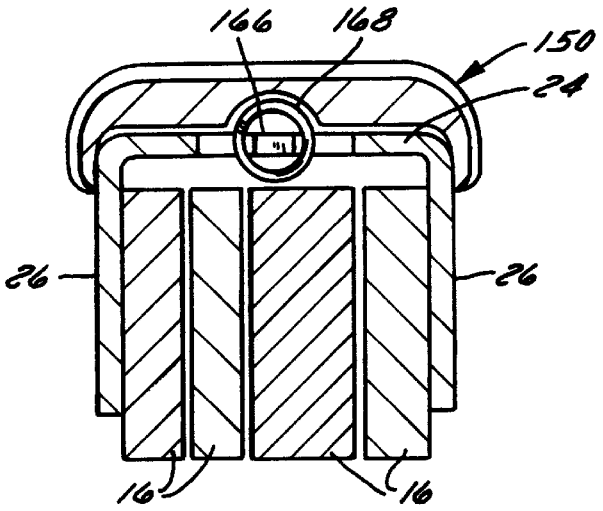
FIG. 16 is a cross-sectional view taken generally along line 16—16 of FIG. 13.

Referring to FIGS. 11–13, the operation of locking mechanism 20 will be described. As shown in FIG. 11 ancillary tool 16 is in the extended position. In this position wedge 170 is biased by spring 168 such that second beveled region 178 is in contact with locking surface 198 of ancillary tool 16. Further, when wedge 170 is biased toward locking edge 33, a portion of top surface 172 proximate front edge 180 of wedge 170 is in contact with bottom surface 30 of web 24. In the extended position back edge 196 of ancillary tool 16 is in contact with locking edge 33 of web 24.

The relative angle between the second beveled region 178 and locking surface 198 is selected by design for suitable operation of lock 20, i.e., to positively lock the extended implement while preventing jamming. Additionally, by design the point of contact of the second beveled region 178 and locking surface 198 is behind the longitudinal axis of axle bolt 122. This arrangement provides positive rotational lock up of ancillary tool 16 in the extended position.

Referring to FIG. 12 ancillary tool 16 is released from the locked extended position by retraction of wedge 170 from locking surface 198. This is accomplished by translating lock release button 150 away from locking edge 33 of web 24. A user applies force to button 150 thereby overcoming the spring force of spring 168. Once second beveled region 178 clears locking surface 198 ancillary tool 16 can be rotated from the open extended position to a closed retracted position. As illustrated in FIG. 12, arcuate portion 200 acts as a cam against front edge 180 of wedge 170 to maintain button 150 in a retracted position as ancillary tool 16 is being rotated to the closed retracted position.

Once arcuate portion 200 clears front edge 180 of wedge 170, spring 168 will bias button 150 and wedge 170 forward toward distal edge 33 of web 24. In FIG. 13 ancillary tool 16 is shown in the closed retracted position.

Ancillary tool 16 is rotated from the closed position to an open extended position by manual rotation of working portion 192. It is not necessary to manually retract button 150 and wedge 170 to permit rotation of ancillary tool 16 from the closed position to the open position. As ancillary tool 16 is rotated from the closed position, opening tang 202 engages front edge 180 of wedge 170 and forces wedge 170 away from locking edge 33 of web 24. The biasing action of spring 168 will force ancillary tool 16 back to the retracted position if released within approximately the first 40 degrees of travel. After approximately the first 40 degrees of travel ancillary tool 16 will retain the position at which it is released. Finally, once ancillary tool 16 is in the extended position, spring 168 biases second beveled surface 178 against locking surface 198 to lock tool 16 in an extended position.

Figure 15:
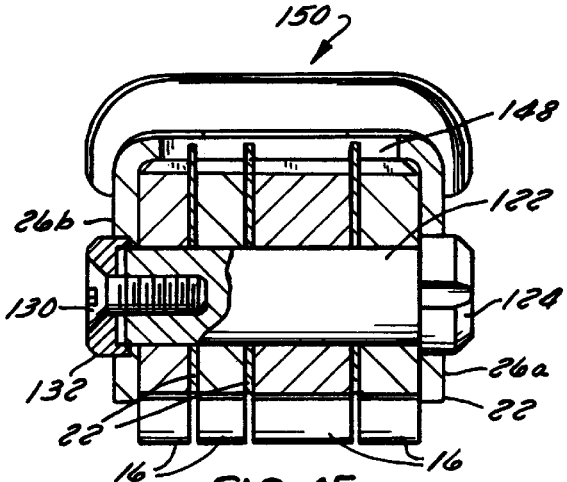
FIG. 15 is a cross-sectional view taken generally along line 15—15 of FIG. 13.

Referring generally to FIGS. 10, 15 and 17 anti-rotational washers 22 will now be described. Anti-rotational washers 22 include a central aperture 204, an outer surface 206, and a protrusion 208 extending from the outer surface. Protrusion 208 includes a top portion 210.

Each washer 22 includes a first flat region 212 proximate protrusion 208 and a second flat region 214 distal protrusion 208. First flat region 212 has a profile substantially similar to locking surface 198 of tang portion 194 when implement 16 is in the open extended position (See FIG. 11). Second flat region 214 has a profile substantially similar to the profile of locking surface 198 when implement 16 is in a closed retracted position (See FIG. 13). However, first and second regions 212, 214 may have other complimentary profiles as well.

Each washer 22 is attached to axle bolt 122 about aperture 204. Each washer 22 is located between respective adjacent implements 16 thereby separating adjacent implements. (See FIG. 15). A portion of protrusion 208 of each washer 22 is located within key slot 148. (See FIG. 11). In this manner each washer 22 is radially fixed relative to a longitudinal axis of axle bolt 122.

Washers 22 act to prevent the rotation of adjacent implements 16 when a single implement 16 is pivoted from the closed retracted position to the open extended position.

As noted above once axle bolt is secured with screw 130, washers 22 are located between respective adjacent implements and are both radially and longitudinally fixed about axle bolt 122. This arrangement prevents the transfer of a rotational force from a pivoted implement to an adjacent implement.

Additionally, the profile of first flat region 212 of washer 22 cooperates with locking mechanism 20, to permit wedge 170 to travel toward locking edge 33 without interference from washer 22.

Figure 19:
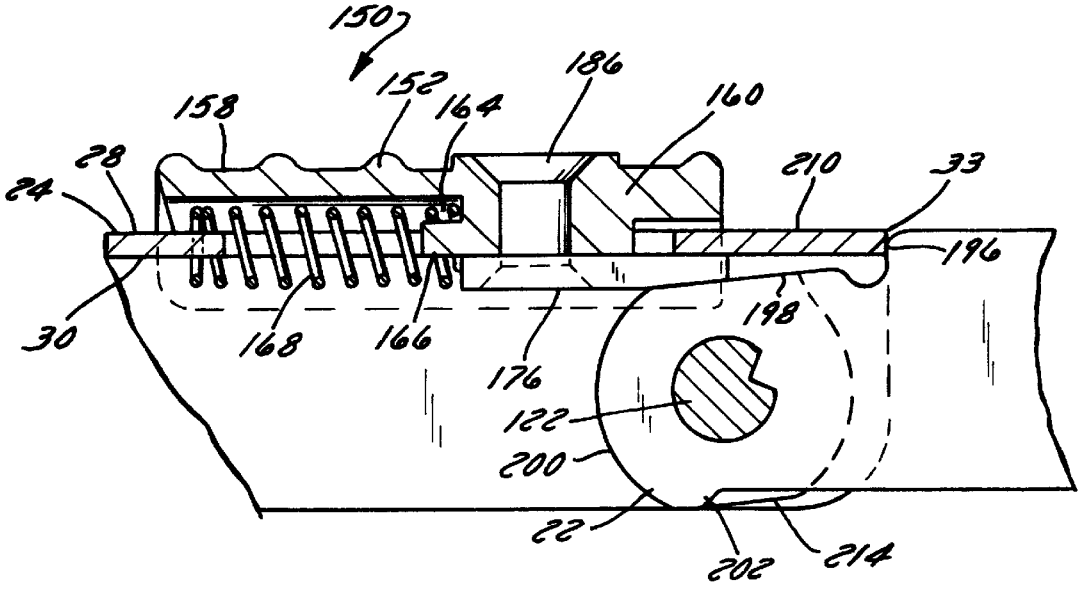
FIG. 19 is a sectional view of a locking mechanism in an alternative exemplary embodiment of the anti-rotational washers with a blade in the extended open position.

However, washer 22 and axle bolt 122 may have other configurations. For example, return to FIG. 19, axle bolt 122 may include a keyed shaft having a groove extending along the longitudinal axis of axle bolt 122. Washer 22 may also include a protrusion extending into aperture 204. The protrusion extending into aperture 204 would be slidably located within the groove in axle bolt 122. While each washer 22 would be able to slide along the longitudinal axis of axle bolt 22, it would be prohibited from rotating about axle bolt 122. Protrusion 208 could therefore be eliminated. Although, this alternative embodiment has been described with a single groove and matching protrusion, it is possible for the axle and washer to include two or more grooves and matching protrusions.

Referring to FIGS. 3 and 10, the features which permit rotation of ancillary tools 16 from the retracted position to the will be discussed. Each ancillary tool 16 includes a pair of opposed side surfaces 216, a top edge 218, a first end 220 distal tang portion 194 and a second end 222 distal the working portion 192. Each side wall 26 is provided with a semi-circular opening 224 located distal web 24 to permit access to the ancillary tool adjacent each respective side wall 26. Each ancillary tool adjacent side wall 26 tool may include a depression 226 in the side surface 216 proximate side wall 26. Depression 226 facilitates the rotation of the ancillary tool by a user. Typically, depression 226 is configured to permit insertion of a user's fingernail to facilitate rotation of the ancillary tool from the closed position.

However, such a depression would not be accessible for ancillary tools 16 which are intermediate the ancillary tools adjacent side walls 26. It would be possible to access a depression located in side surface 216 of an ancillary tool 16 intermediate adjacent tools by first removing at least one adjacent tool. In the preferred embodiment, some ancillary tools 16 which are exemplified in FIG. 3 as ancillary tools 17 include a notch 228 located in a top edge 218 of the ancillary tool.

In this manner, a fingernail or fingertip may be inserted in notch 228 without the need to first remove an adjacent tool. In the preferred embodiment notch 228 is located in working portion 192 intermediate first and second ends 220, 222. Alternatively, a means for opening ancillary tools 27 may include a protrusion extending from top edge 218.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A multi-function tool provided with a mechanism to lock at least one of a plurality of implements pivotally attached to the tool, the tool comprising:

channel-shaped handle including a web and a pair of sides extending therefrom, the web having a locking edge, a top surface, and an oppositely facing bottom surface;

an axle extending transversely between the pair of sides proximate the locking edge;

a plurality of implements pivotally mounted to the axle, each implement having a working portion and an opposed tang portion provided with a planar locking surface;

a wedge including a beveled region, the wedge being slidably attached to the handle for engagement with the locking surface of one of the implements when the one of the implements is in an extended position; and a spring attached to the handle to bias the beveled region of the wedge into engagement with the locking surface when the implement is in the extended position, wherein an angle of the locking surface and an angle of the beveled region are not equal when the beveled region is engaged with the locking surface.

2. The multi-function tool of claim 1, further including a button extending through an opening extending through the web and attached to the wedge, the button including a top portion located adjacent the top surface of the web, and a heel portion the wedge being attached to the heel and adjacent the bottom surface of the web.

3. The multi-function tool of claim 2, wherein the web includes a spring post extending into the opening, the heel including an attachment means, the spring being positively disposed between the spring post and attachment means.

4. The multi-function tool of claim 1, wherein the beveled region and the locking surface of the implement are in contact at a predetermined distance from the axle distal the locking edge when the implement is in the extended position.

5. The multi-function tool of claim 1, wherein the working portion of the implement includes a top edge having a notch therein to permit insertion of a fingertip to pivot the implement.

6. A multi-function tool provided with a mechanism to lock at least one of a plurality of implements pivotally attached to the tool, the tool comprising:

a channel-shaped handle including a web and a pair of sides extending therefrom, the web having a locking edge, a top surface, an oppositely facing bottom surface and;

an axle extending transversely between the pair of sides proximate the locking edge;

plurality of implements pivotally mounted to the axle, each implement having a working portion and an opposed tang portion provided with a locking surface;

a wedge slidably attached to the web for engagement with the locking surface of one of the implements when the one of the implements is in an extended position; and a spring attached to the handle to bias the wedge into engagement with the locking surface;

a plurality of washers, each of the plurality of washers being attached to the axle and separating respective adjacent implements disposed adjacent thereto, the web including a slot transverse the first and second sides located intermediate the axle and the locking edge, each washer including a protrusion extending therefrom and received in the slot.

7. A multi-function tool provided with a mechanism to lock at least one of a plurality of implements pivotally attached to the tool, the tool comprising:

a channel-shaped handle including a web and a pair of sides extending therefrom, the web having a locking edge, a top surface, an oppositely facing bottom surface;

an axle extending transversely between the pair of sides proximate the locking edge;

a plurality of implements pivotally attached to the axle, each implement having a working portion and an opposed tang portion provided with a locking surface;

a wedge slidably attached to the web for engagement with the locking surface of one of the implements when the one of the implements is in an extended position; and a spring attached to the handle to bias the wedge into engagement with the locking surface;

a plurality of washers, each of the plurality of washers being attached to the axle and separating respective adjacent implements disposed adjacent thereto, the web including a slot transverse the first and second sides located intermediate the axle and the locking edge, each washer including a protrusion extending therefrom and received in the slot, wherein each washer includes a first region proximate the protrusion having a profile complimentary to the locking surface.

8. A lock mechanism for a tool having a channel-shaped handle, an axle attached thereto, and a plurality of implements pivotally attached to the axle, the channel-shaped handle having a web including an opening and a pair of sides extending therefrom, the lock mechanism comprising:

a wedge slidably attached to the web for releasable engagement with the implements to prevent rotation of each implement relative to the handle when the implement is in an extended position, the wedge including a beveled region;

a spring attached to the handle and the wedge to bias the beveled region of the wedge into engagement with the locking surface when the implement is in the extended position, wherein an angle of the locking surface and an angle of the beveled region are not equal when the beveled region of the wedge is engaged with the locking surface of the implement; and a button attached to the wedge, the button including a top section a portion of which is located proximate the top surface of the web, and a heel section extending through the opening, the wedge being adjacent the bottom surface of the web.

9. The multi-function tool of claim 8, wherein the web includes a spring post extending into the opening, the heel including a fastening means, the spring being positively disposed between the spring post and the fastening means.

10. A lock mechanism for a tool having a channel-shaped handle, an axle attached thereto, and a plurality of implements pivotally mounted to the axle, the channel-shaved handle having a web including an opening and a pair of sides extending therefrom, the lock mechanism comprising:

a wedge slidably attached to the web for releasable engagement with the implements to prevent rotation of each implement relative to the handle when the implement is in an extended position;

a spring attached to the handle to bias the wedge against the implements; and a button attached to the wedge, the button including a top section a portion of which is located on the top surface of the web, and a heel section extending through the opening, the wedge being adjacent the bottom surface of the web;

wherein the-web includes a spring post extending into the opening, the heel including a fastening means, the spring being positively disposed between the spring post and the fastening means:

a plurality of washers, each washer being attached to the axle and being located between respectively adjacent implements, the web including a slot transverse the first and second sides and formed intermediate the axle and the locking edge, each washer including a protrusion extending therefrom and received in the slot.

11. A lock mechanism for a tool having a channel-shaped handle, an axle attached thereto, and a plurality of implements pivotally attached to the axle, the channel-shard handle having a web including an opening and a pair of sides extending therefrom, the lock mechanism comprising:

a wedge slidably attached to the web for releasable engagement with the implements to prevent rotation of each implement relative to the handle when the implement is in an extended position;

a spring attached to the handle to bias the wedge against the implements; and a button attached to the wedge, the button including a top section a portion of which is located on the ton surface of the web, and a heel section extending through the opening, the wedge being adjacent the bottom surface of the web;

wherein the web includes a spring post extending into the opening, the heel including a fastening means, the spring being positively disposed between the spring post and the fastening means;

a plurality of washers, each washer being attached to the axle and being located between respectively adjacent implements, the web including a slot transverse the first and second sides and formed intermediate the axle and the locking edge, each washer including a protrusion extending therefrom and received in the slot wherein each washer includes a first region proximate the protrusion having a profile substantially similar to a locking surface.

12. A multi-function tool comprising:

a handle including a pair of side panels;

an axle extending transversely between the pair of side panels;

a plurality of implements pivotally attached to the axle for pivoting from a fully retracted position to an extended position, each implement having a working portion, and an opposed tang portion provided with a locking surface, and a recessed surface;

a wedge slidably attached to the handle for engagement with the locking surface of one of the implements when the one of the implements is in the extended position; and a biasing means urging the wedge into engagement with the locking surface of one of the plurality of implements when the one of the plurality of implements is in the extended position and the remaining of the plurality of implements are in the fully retracted position, wherein the wedge does not contact the recessed surfaces of the remaining of the plurality of implements in the fully retracted position.

* * * * *